US008474947B2

(12) United States Patent
Doran et al.

(10) Patent No.: US 8,474,947 B2
(45) Date of Patent: Jul. 2, 2013

(54) PRINTHEAD ASSEMBLY HAVING GROOVES EXTERNALLY EXPOSING PRINTHEAD DIE

(75) Inventors: John Doran, Leinster (IE); Joseph R. Elliot, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 384 days.

(21) Appl. No.: 12/919,734

(22) PCT Filed: Feb. 27, 2008

(86) PCT No.: PCT/US2008/055199
§ 371 (c)(1),
(2), (4) Date: Aug. 26, 2010

(87) PCT Pub. No.: WO2009/108195
PCT Pub. Date: Sep. 3, 2009

(65) Prior Publication Data
US 2011/0001786 A1 Jan. 6, 2011

(51) Int. Cl.
*B41J 2/165* (2006.01)
*B41J 2/135* (2006.01)

(52) U.S. Cl.
USPC ..... 347/22; 347/29; 347/44

(58) Field of Classification Search
USPC ..... 347/108, 22, 2, 25, 29, 33, 44, 50, 347/54, 58, 97, 61, 30
See application file for complete search history.

(56) References Cited

U.S. PATENT DOCUMENTS

| | | | | |
|---|---|---|---|---|
| 4,626,323 | A * | 12/1986 | Trausch | 205/127 |
| 4,924,241 | A * | 5/1990 | Parks et al. | 347/54 |
| 5,027,134 | A | 6/1991 | Harmon et al. | |
| 5,216,449 | A | 6/1993 | English | |
| 5,517,220 | A | 5/1996 | English | |
| 5,648,806 | A * | 7/1997 | Steinfield et al. | 347/87 |
| 5,751,324 | A * | 5/1998 | Brandon et al. | 347/87 |
| 5,924,198 | A | 7/1999 | Swanson et al. | |
| 6,030,075 | A * | 2/2000 | Swanson et al. | 347/87 |
| 6,137,443 | A * | 10/2000 | Beatty et al. | 347/63 |
| 6,193,362 | B1 | 2/2001 | Nakata et al. | |
| 6,273,562 | B1 | 8/2001 | Deshmukh | |
| 6,412,905 | B1 | 7/2002 | Lin | |
| 6,817,695 | B1 | 11/2004 | Aldrich et al. | |

(Continued)

FOREIGN PATENT DOCUMENTS

| | | |
|---|---|---|
| EP | 0705693 A2 | 4/1996 |
| EP | 0705694 A2 | 4/1996 |

(Continued)

OTHER PUBLICATIONS

Written Opinion and International Search Report in PCT application PCT/US2008/055199, Sep. 24, 2008.

(Continued)

*Primary Examiner* — Stephen Meier
*Assistant Examiner* — Leonard S Liang

(57) ABSTRACT

An inkjet printing device printhead assembly includes a housing. The housing has a surface. A well is defined within the surface of the housing and is adapted to disposal of a printhead die therewithin. The surface of the housing has one or more grooves. The grooves have ends. Some of the ends are adjacent to the wall. The grooves externally expose the printhead die.

17 Claims, 13 Drawing Sheets

U.S. PATENT DOCUMENTS

| | | | | |
|---|---|---|---|---|
| 6,890,068 | B2 | 5/2005 | Kawamura et al. | |
| 7,021,741 | B2 | 4/2006 | Aldrich et al. | |
| 7,896,470 | B2 * | 3/2011 | Doran | 347/50 |
| 2002/0080206 | A1 | 6/2002 | Lin | |
| 2003/0081089 | A1 | 5/2003 | Kawamura et al. | |
| 2003/0141277 | A1 * | 7/2003 | Beatty et al. | 216/27 |
| 2004/0001117 | A1 * | 1/2004 | Choy et al. | 347/29 |
| 2004/0061741 | A1 * | 4/2004 | Aschoff et al. | 347/49 |
| 2004/0207694 | A1 | 10/2004 | Conta et al. | |
| 2004/0246295 | A1 | 12/2004 | Aldrich et al. | |
| 2005/0093912 | A1 | 5/2005 | Vaideeswaran et al. | |
| 2005/0110827 | A1 | 5/2005 | Aldrich et al. | |
| 2007/0019038 | A1 * | 1/2007 | Lee et al. | 347/63 |
| 2007/0263045 | A1 | 11/2007 | Okazawa | |

FOREIGN PATENT DOCUMENTS

| | | | |
|---|---|---|---|
| EP | 795406 | A2 * | 9/1997 |
| EP | 0997284 | A2 | 5/2000 |
| JP | 2003-127354 | A | 5/2003 |
| JP | 2005-066928 | A | 3/2005 |
| WO | 2006062244 | A1 | 6/2006 |

OTHER PUBLICATIONS

Search report, supplementary search report, and examination in counterpart EP patent application 08743588.9, dated Jan. 31, 2011.

* cited by examiner

PRINTHEAD ASSEMBLY HAVING GROOVES EXTERNALLY EXPOSING PRINTHEAD DIE

BACKGROUND

A common way to form images on media, such as paper, is to use a fluid-ejection device, such as an inkjet-printing device. An inkjet-printing device has a number of inkjet-printing mechanisms, such as inkjet printhead assemblies. Each inkjet printhead assembly has a number of inkjet nozzles that eject ink, such as differently colored ink, in such a way as to form a desired image on the media. Many inks are dye-based, but other inks are pigment-based, which are usually more viscous than dye-based inks.

Inkjet printhead assemblies can lose water contained within the ink through the inkjet nozzles. When too much water is lost from the ink, the viscosity of the ink can increase, and/or the ink suspension can become unstable. To ameliorate this issue, inkjet printhead assemblies are commonly capped inside and/or outside the inkjet-printing devices when they are not being used for extended periods of time.

However, when inkjet printhead assemblies are capped, insufficient vapor loss from the printhead assemblies may occur. A vapor loss rate below a certain threshold can cause particle flocculation within the ink, where the solute of the ink comes out of the solution of the ink. As a result, poor image formation quality can result when the inkjet printhead assemblies are uncapped and are used to form a desired image on media.

DETAILED DESCRIPTION OF THE DRAWINGS

Figure 1:
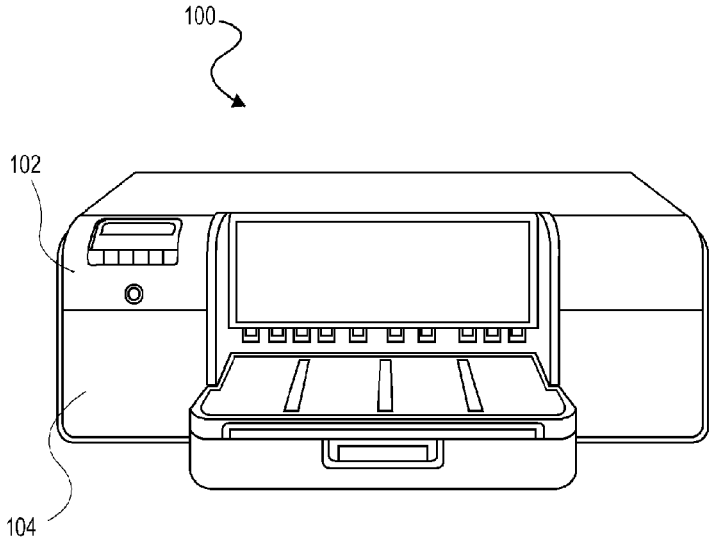
FIG. 1 is a diagram of a representative inkjet-printing device, according to an embodiment of the present disclosure.

FIG. 1 shows a representative inkjet-printing device 100, according to an embodiment of the present disclosure. The inkjet-printing device 100 is a device, such as a printer, that ejects ink onto media, such as paper, to form images, which can include text, on the media. The inkjet-printing device 100 is more generally a fluid-ejection device that ejects fluid, such as ink.

The inkjet-printing device 100 may eject pigment-based ink, dye-based ink, or another type of ink. Differences between pigment-based inks and dye-based inks include that the former is generally more viscous than the latter, among other differences. The inkjet-printing device 100 includes at least two access doors: an access door 102, and an access door 104. The access door 104 is opened to permit a user to remove and insert ink cartridges into and from the inkjet printing device 100. The access door 102 is opened to permit a user to remove and insert inkjet printheads into and from the inkjet printing device 100.

Figure 2A:
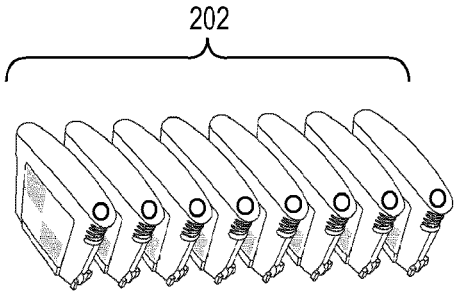
FIGS. 2A and 2B are diagrams of inkjet cartridges and how they are inserted into an inkjet-printing device, according to an embodiment of the present disclosure.

FIG. 2A shows a number of ink cartridges 202 that may be inserted into the inkjet-printing device 100, according to an embodiment of the present disclosure. In one embodiment, there may be eight such ink cartridges 202. These ink cartridges 202 may include photo black pigment-based ink cartridge, a light gray pigment-based ink cartridge, and a matte black pigment-based ink cartridge. These ink cartridges 202 may further include a cyan pigment-based ink cartridge, a magenta pigment-based ink cartridge, a yellow pigment-based ink cartridge, a light magenta pigment-based ink cartridge, and a light cyan pigment-based ink cartridge. Having eight such ink cartridges 202 enables the inkjet-printing device 100 to print photorealistic full-color images on media.

In another embodiment, however, there may be just four ink cartridges 202. The ink cartridges 202 in this embodiment may include black, cyan, magenta, and yellow ink cartridges. Having four such ink cartridges enables the inkjet-printing device 100 to print full-color images on media, but generally not as photorealistic as when there are eight ink cartridges 202. In still another embodiment, there may be just a single black ink cartridge 202. In this embodiment, the inkjet-printing device 100 can print black-and-white and grayscale images on media, but not color images.

Figure 2B:
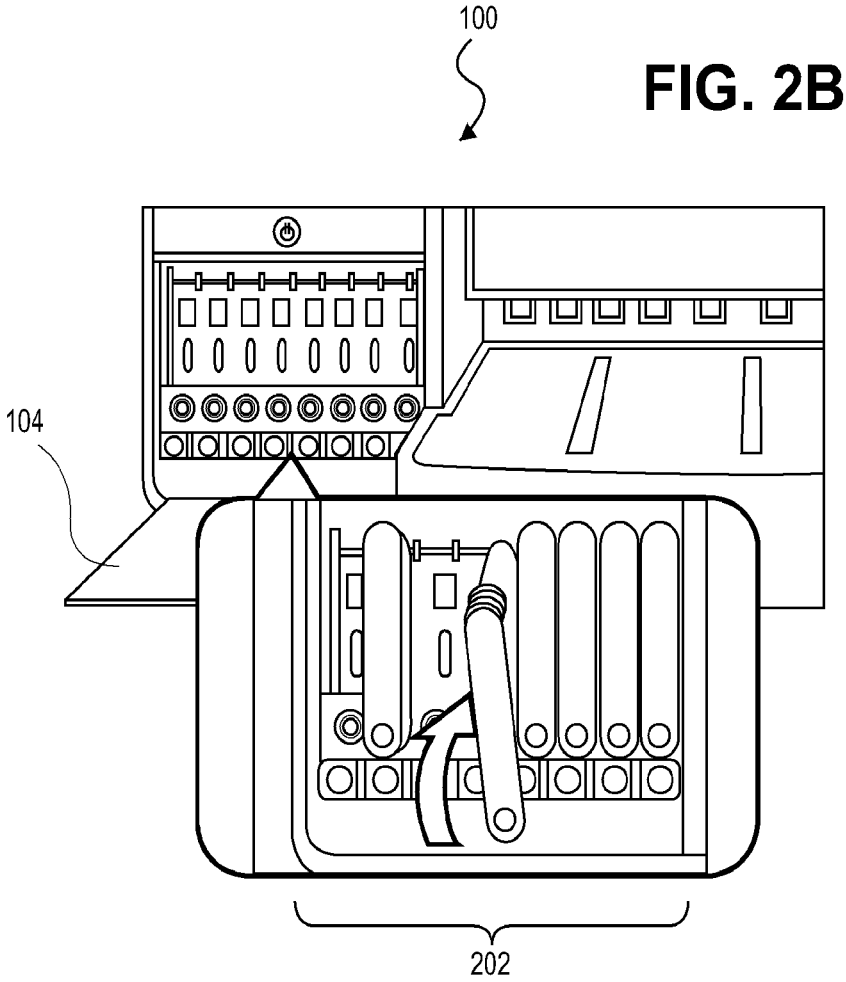

FIG. 2B shows how the ink cartridges 202 may be inserted into the inkjet-printing device 100, according to an embodiment of the present disclosure. The access door 104 is opened downwards. Opening the access door 104 reveals a number of slots. The ink cartridges 202 can be inserted into and removed from these slots of the inkjet-printing device 100. The ink cartridges 202 supply the differently colored ink by which the inkjet-printing device 100 forms images on media. The inkjet cartridges 202 are more generally fluid supplies, such as supplies of ink.

Figure 3A:
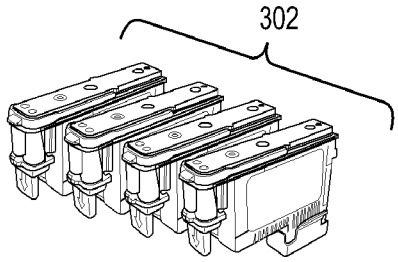
FIGS. 3A and 3B are diagrams of inkjet printheads and how they are inserted into an inkjet-printing device, according to an embodiment of the present disclosure.

FIG. 3A shows a number of inkjet printheads 302 that may be inserted into the inkjet-printing device 100, according to an embodiment of the present disclosure. The inkjet printheads 302 are more generally fluid-ejection mechanisms, in that they are the actual mechanisms that eject fluid, such as ink, onto media to form images on the media. The inkjet printheads 302 may also be referred to as inkjet printing device printhead assemblies, or just inkjet printhead assemblies. There may be four such inkjet printheads 302 in one embodiment of the present disclosure. One inkjet printhead may be responsible for ejecting photo black and light gray ink. Another inkjet printhead may be responsible for ejecting matte black and cyan ink. A third inkjet printhead may be responsible for ejecting magenta and yellow ink. The last inkjet printhead may be responsible for ejecting light magenta and light cyan ink.

In another embodiment, however, there may be just two inkjet printheads 302, in the case where there are just four differently colored inks, cyan, magenta, yellow, and black. One of these inkjet printheads may be responsible for ejecting black ink, whereas the other printhead may be responsible for ejecting cyan, magenta, and yellow ink. In still another embodiment, there may be just a single inkjet printhead, in the case where there is just black ink, such that the single inkjet printhead ejects this black ink.

Figure 3B:
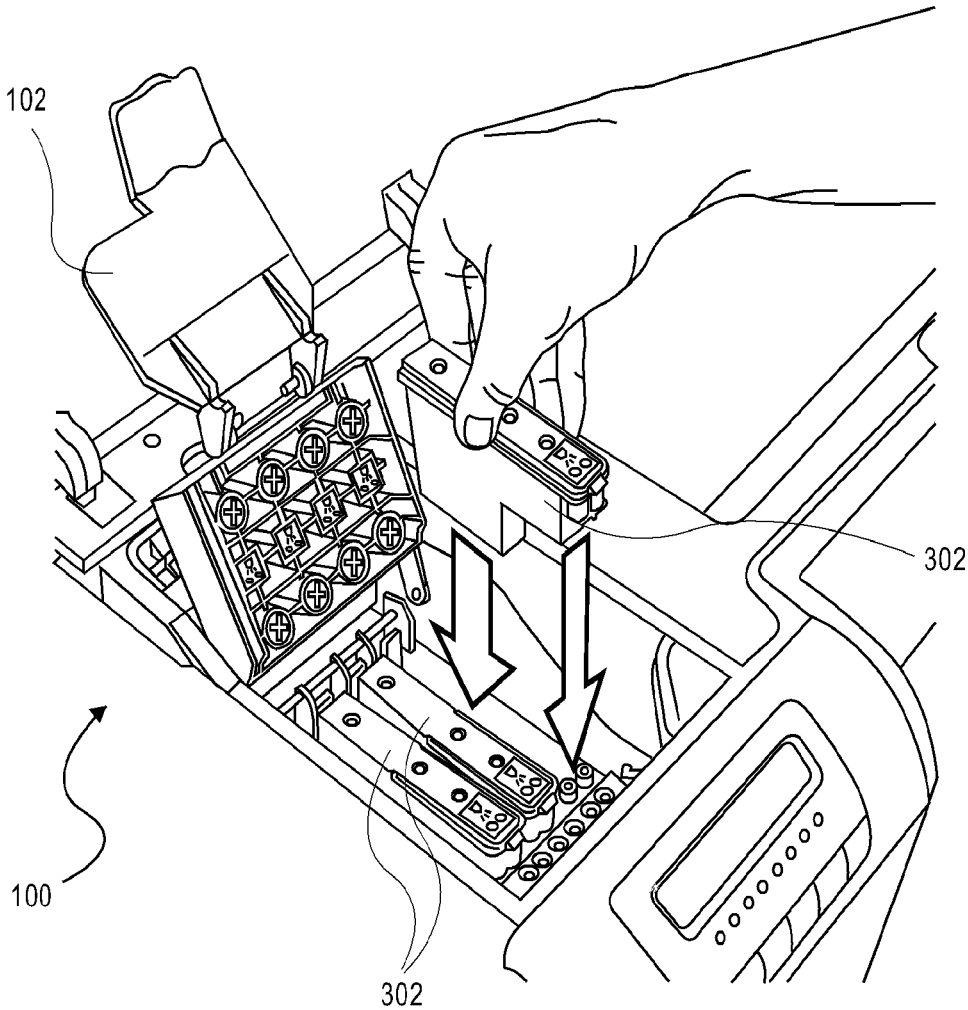

FIG. 3B shows how the inkjet printheads 302 may be inserted into the inkjet-printing device 100, according to an embodiment of the present disclosure. The access door 102 is opened upwards. Opening the access door 102 reveals a number of slots. The inkjet printheads 302 can be inserted into and removed from these slots of the inkjet-printing device 100. The inkjet printheads 302 thus eject the ink supplied by the ink cartridges 202 to form images on media.

The embodiments of the present disclosure that have been described in relation to FIGS. 2A, 2B, 3A, and 3B employ ink supplies—the ink cartridges 202—that are separate from the inkjet printheads 302. However, in another embodiment, the inkjet cartridges 202 may be integrated within the inkjet printheads 302. That is, the inkjet printheads 302 may themselves include supplies of ink, such that there are no separate inkjet cartridges 202 per se to be inserted into and removed from the inkjet-printing device 100.

Figure 4:
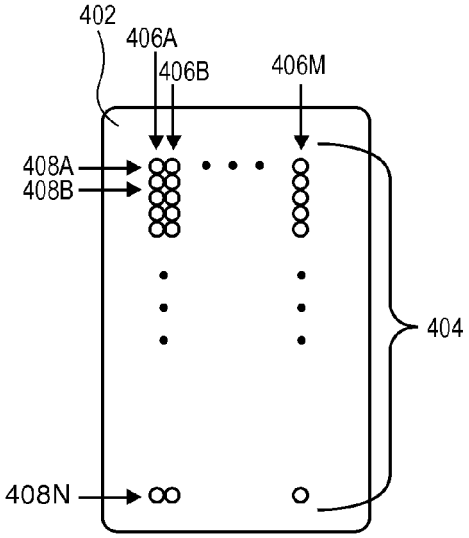
FIG. 4 is a diagram of an inkjet printhead having a number of inkjet nozzles, according to an embodiment of the present disclosure.

FIG. 4 shows a detailed view of an inkjet printhead 402, according to an embodiment of the present disclosure. The inkjet printhead 402 exemplifies each of the inkjet printheads 302 that have been described. The side or surface of the inkjet printhead 402 from which ink is actually ejected is specifically depicted in FIG. 4.

The inkjet printhead 402 includes a number of inkjet nozzles 404, which may more generally be referred to as fluid-ejection nozzles. The inkjet nozzles 404 are organized over a number of columns 406A, 406B, . . . 406M, collectively referred to as the columns 406, and a number of rows 408A, 408B, . . . 408N, collectively referred to as the rows 408. In one embodiment, for example, there may be four columns 406 and 523 rows 408, for a total of 2,112 inkjet nozzles 404.

The inkjet nozzles 404 are the orifices from which ink, or fluid, is ejected out of the inkjet printhead 402. The surface of the inkjet printhead 402 shown in FIG. 4 may be referred to as the orifice plate, which comes into close contact with the media so that ink can be precisely ejected from the inkjet nozzles 404 onto the media in a desired manner. The inkjet nozzles 404, especially in the case where the ink is a pigment-based ink, are susceptible to clogging.

Figure 5:
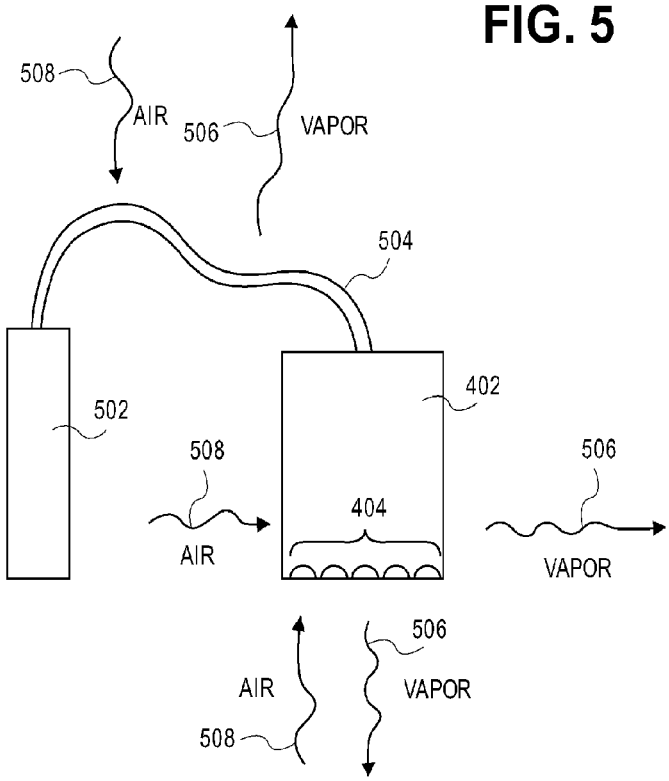
FIG. 5 is a diagram depicting an ink cartridge supplying ink to an inkjet printhead via tubing, according to an embodiment of the present disclosure.

FIG. 5 shows diagrammatically how ink can be supplied from an ink cartridge 502 to the inkjet printhead 402, according to an embodiment of the present disclosure. The ink cartridge 502 exemplifies each of the ink cartridges 202 that have been described. Tubing 504 connects the ink cartridge 502 so the inkjet printhead 402, so that ink can be supplied to the printhead 402 for ejection by the inkjet nozzles 404. As has been noted, in another embodiment, the inkjet cartridge 202 may be integrated within the inkjet printhead 402 in another embodiment. That is, the inkjet printhead 402 may itself include supplies of ink, such that there is no separate inkjet cartridge 502 per se.

When the inkjet printhead 402 remains unused for a period of time, and thus does not eject ink from the inkjet nozzles 404 thereof, two effects may occur. First, vapor, such as water vapor, may be lost from the ink contained within the tubing 504, the inkjet nozzles 404, and/or the body of the inkjet printhead 402 itself, as indicated by arrows 506 in FIG. 5. Second, air may be gained within the ink within the tubing 504, the inkjet nozzles 404, and/or the body of the inkjet printhead 402 itself, as indicated by arrows 508 in FIG. 5.

To prevent these situations from occurring, the inkjet printhead 402 may be capped when it is unused for a period of time, either in the inkjet-printing device 100 itself, or when the printhead 402 remains outside the device 100. Capping the inkjet printhead 402 means that the inkjet nozzles 404 are covered so that air cannot easily gain entry into the nozzles 404, and so that vapor cannot easily escape from the nozzles 404. However, as has been noted in the background, if the vapor loss rate is decreased by such capping below a certain threshold that is determined on an ink type-by-ink type basis, the solute of the ink can come out of the solution of the ink. As a result, poor image formation quality can result when the printhead 402 is uncapped and used to form a desired image on media such as paper.

Embodiments of the present disclosure are concerned with maintaining a sufficient vapor loss rate of vapor through the inkjet nozzles of an inkjet printing device printhead assembly, even when the printhead is capped, by providing a number of grooves that externally expose a printhead die encompassing the nozzles. The number and size of the grooves are empirically or otherwise determined, such as by modeling, to ensure that the desired vapor loss rate occurs. Furthermore, the grooves can be configured so that wiping and capping of the printhead die and thus wiping and capping of the inkjet nozzles within the printhead die are unaffected by the grooves.

Figure 6:
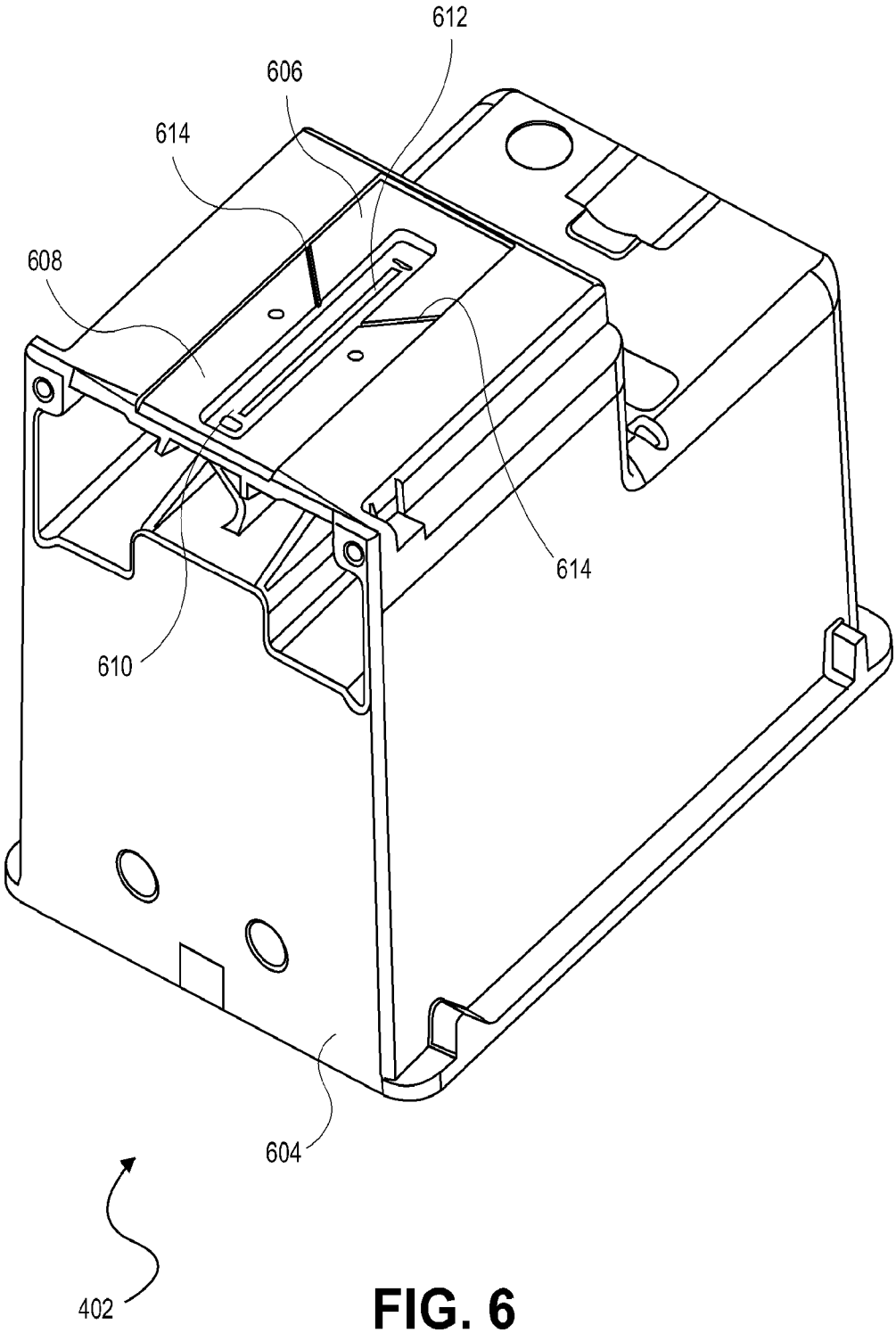
FIG. 6 is a diagram of an inkjet printhead having a number of grooves to maintain a sufficient rate of vapor loss, according to an embodiment of the present disclosure.
Figure 7:
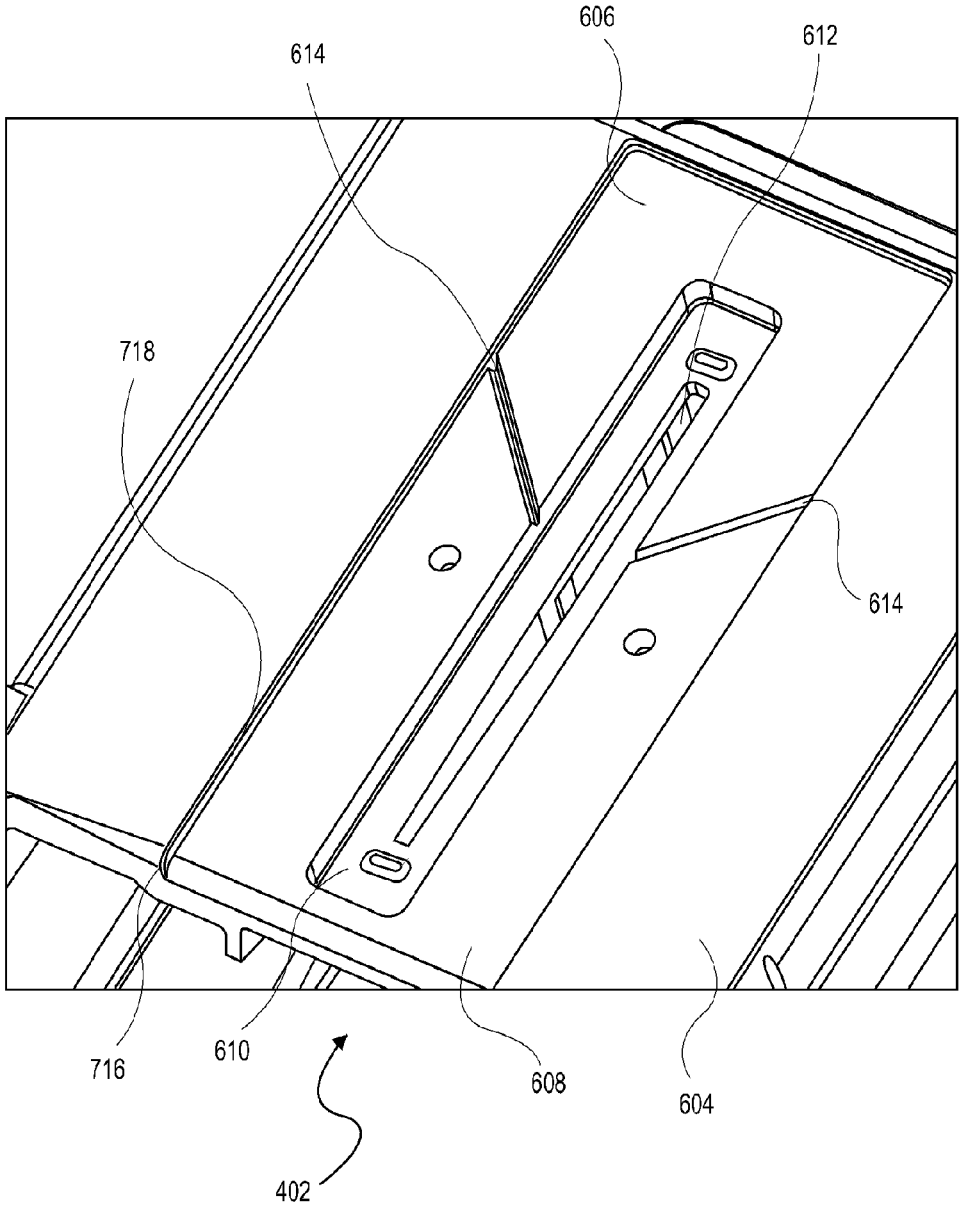
FIG. 7 is a diagram of the inkjet printhead of FIG. 6 in more detail, according to an embodiment of the present disclosure.

FIG. 6 shows the inkjet printhead 402 having two such grooves 614 and FIG. 7 shows a portion of the inkjet printhead 402 of FIG. 6 in detail, according to an embodiment of the present disclosure. The inkjet printhead 402 includes a housing 604. The housing 604 includes a surface 606. In one embodiment, the housing 604 includes a plate 608 of which the surface 606 may be considered a part. However, in another embodiment, the housing 604 may not include the plate 608.

In the embodiment where the housing 604 includes the plate 608, the housing 604 includes an indentation 716 within which the plate 608 is affixably located, as can particularly be seen in FIG. 7. There are additional grooves 718 defined by the outer sides of the plate 608 and the sides of the indentation 716, as can also particularly be seen in FIG. 7. The grooves 718 are different than the grooves 614, however.

The surface 606 defines a well 610. The well 610 is adapted to a printhead die being affixably disposed therein, as will be described in more detail later in the detailed description. There is also a hole 612 within a wall of the housing 604. The hole 612 is covered by the printhead die when the die is disposed within the well 610. Ink is supplied to the printhead die through the hole 612, such that it can be said that the hole 612 is adapted for this purpose.

The grooves 614 are located within the surface 606. The inner ends of the grooves 614 are adjacent to the well 610. The outer ends of the grooves 614 externally expose the printhead die that is affixably disposed within the well 610. For instance, as depicted in FIG. 7 in particular, the outer ends of the grooves 614 are adjacent to the grooves 718. Thus, the grooves 614 extend from the well 614 to the grooves 718.

Figure 8:
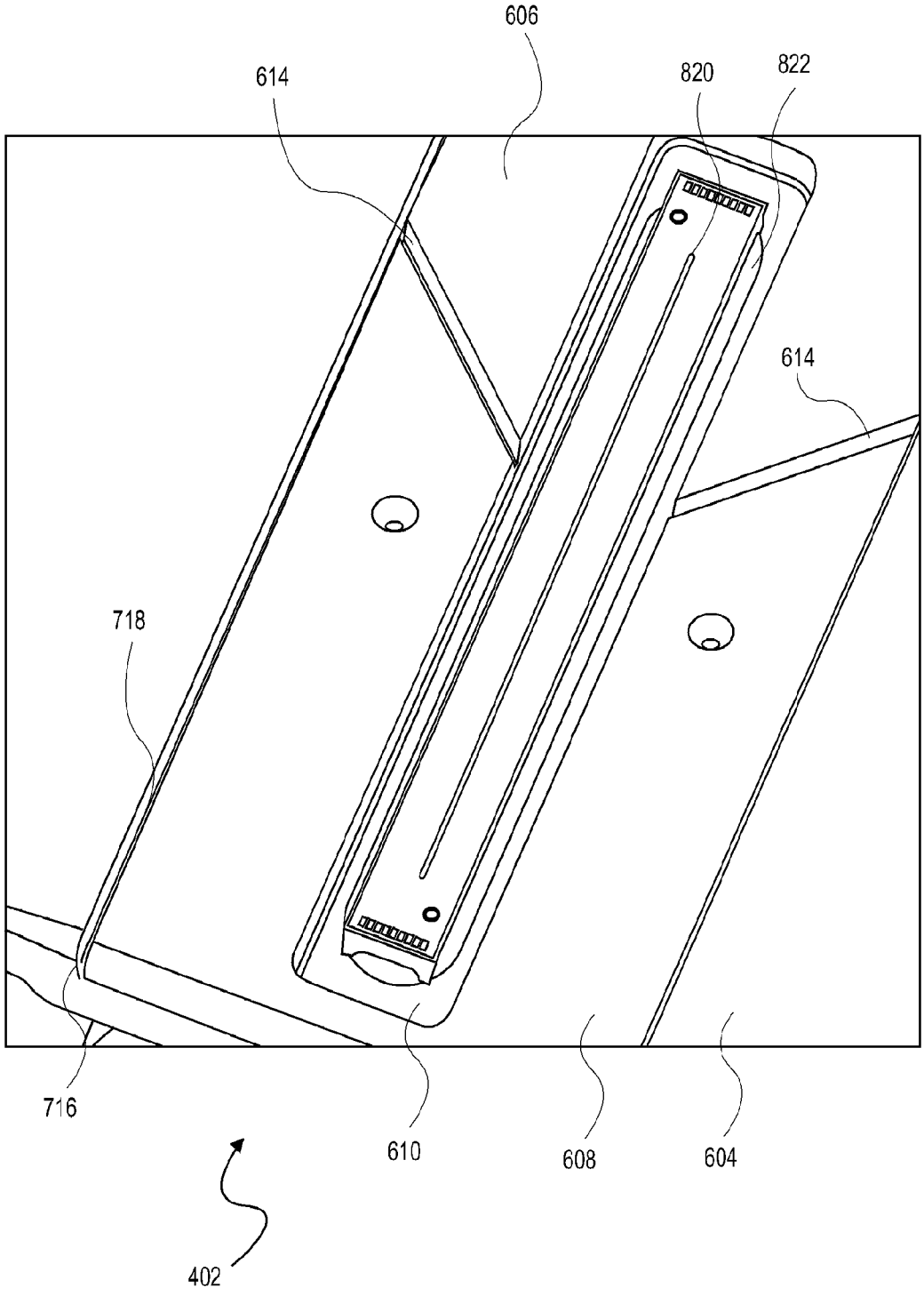
FIG. 8 is a diagram of the inkjet printhead of FIGS. 6 and 7 in which an inkjet printhead die is shown disposed within the printhead, according to an embodiment of the present disclosure.

FIG. 8 shows the inkjet printhead 402 of FIGS. 6 and 7 in which an inkjet printhead die 820 has been affixably disposed within the well 610, covering the hole 612 of FIGS. 6 and 7, according to an embodiment of the present disclosure. The printhead die 820 includes or encompasses the inkjet nozzles 404 that have been described, where the nozzles 404 are not depicted in FIG. 8 for illustrative clarity. An adhesive 822 is used to bond the printhead die 820 within the well 610, and to ensure that ink cannot escape from inside the housing 604 of the printhead 402 around the die 820.

Figure 9:
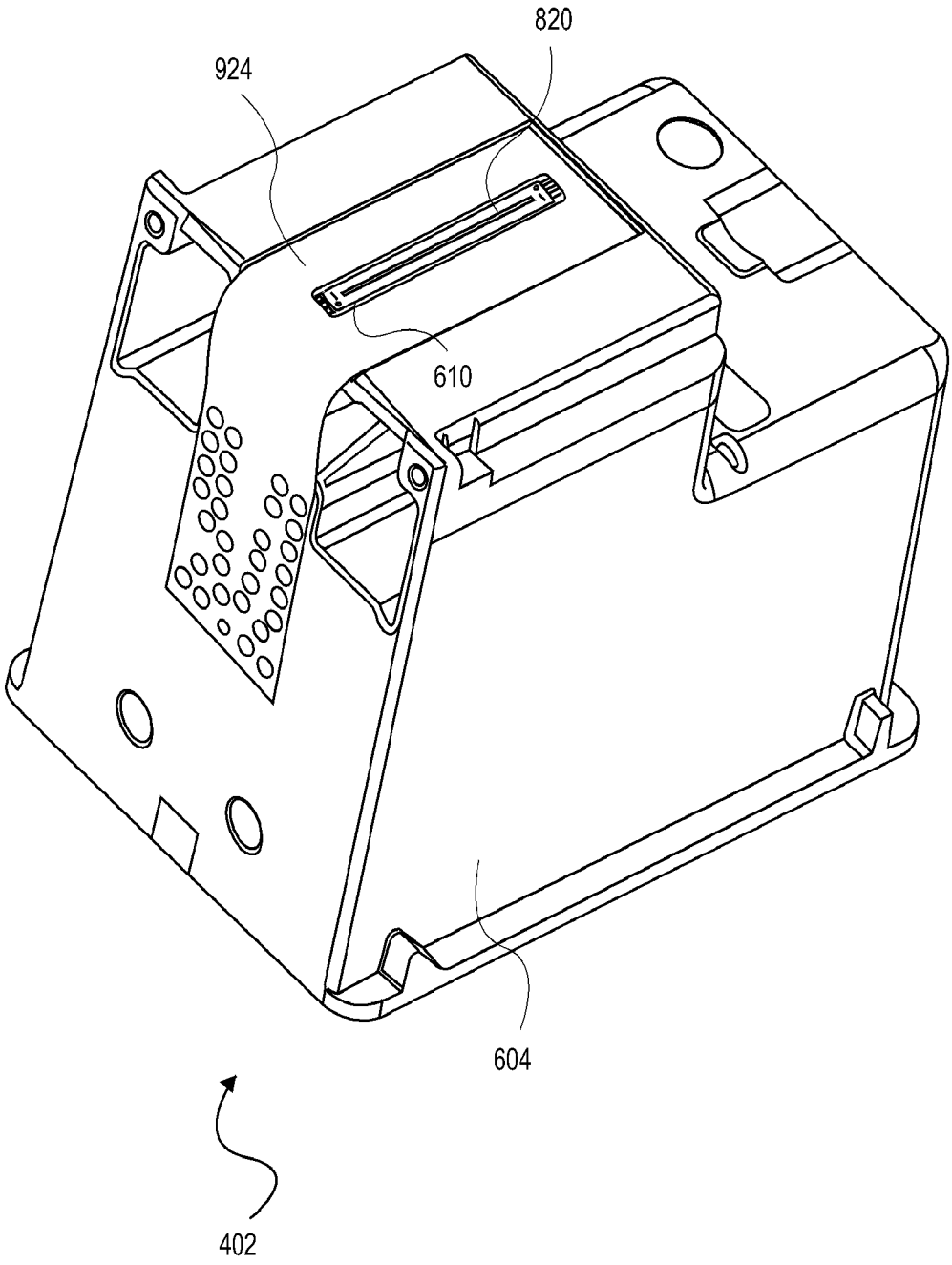
FIG. 9 is a diagram of the inkjet printhead of FIGS. 6, 7, and 8 in which a flexible circuit has been attached to the printhead, according to an embodiment of the present disclosure.
Figure 10:
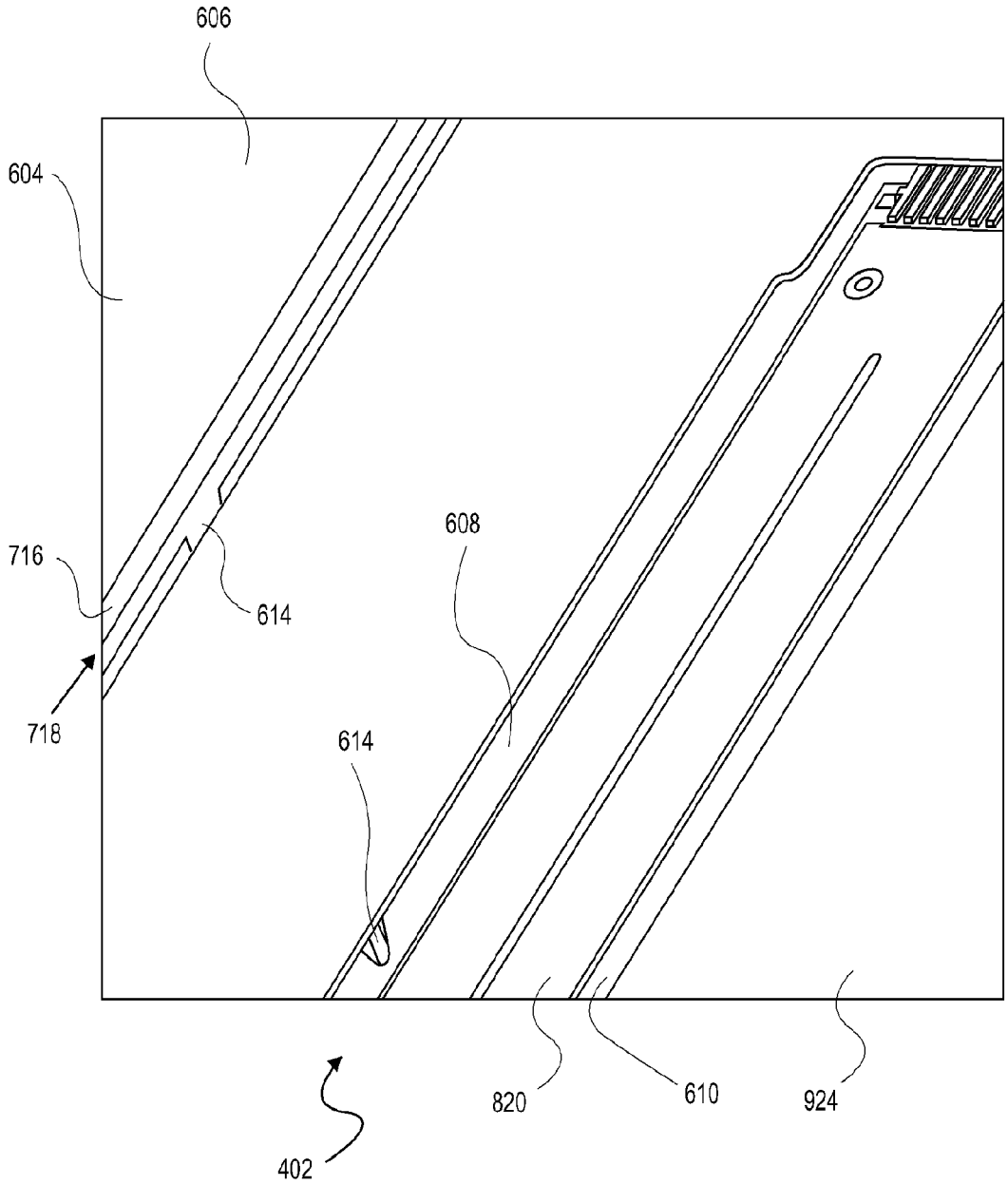
FIG. 10 is a diagram of the inkjet printhead of FIG. 9 in more detail, according to an embodiment of the present disclosure.

FIG. 9 shows the inkjet printhead 402 of FIGS. 6, 7, and 8 in which a flexible circuit 924 has been attached to the housing 604, and FIG. 10 shows a portion of the inkjet printhead 402 of FIG. 9 in more detail, according to an embodiment of the disclosure. The flexible circuit 924 is attached to the surface 606 of the housing 604, such as the surface 606 of the plate 608 of the housing 604. The flexible circuit 924 is electrically connected to the printhead die 820, and thus is the way by which an inkjet-printing device is able to control the printhead die 820 to eject ink from the inkjet printhead 402 through the die 820. The flexible circuit 924 has a hole corresponding to the printhead die 820, so that the majority of the die 820—including the inkjet nozzles thereof, for instance—remains uncovered when the circuit 924 is attached.

The grooves 614 are covered by the flexible circuit 924. However, the ends of the grooves 614 remain exposed even when the bodies of the grooves are covered by the flexible circuit 924. In particular, the inner ends of the grooves 614 remain exposed at the well 610 (i.e., at the sides of the plate 608), and the outer ends of the grooves 614 remain exposed at the grooves 718 (i.e., at the sides of the indentation 716). In this way, vapor emanating from the printhead die 820 is still able to escape through the grooves 614, even when the printhead die 820 is capped.

Figure 11:
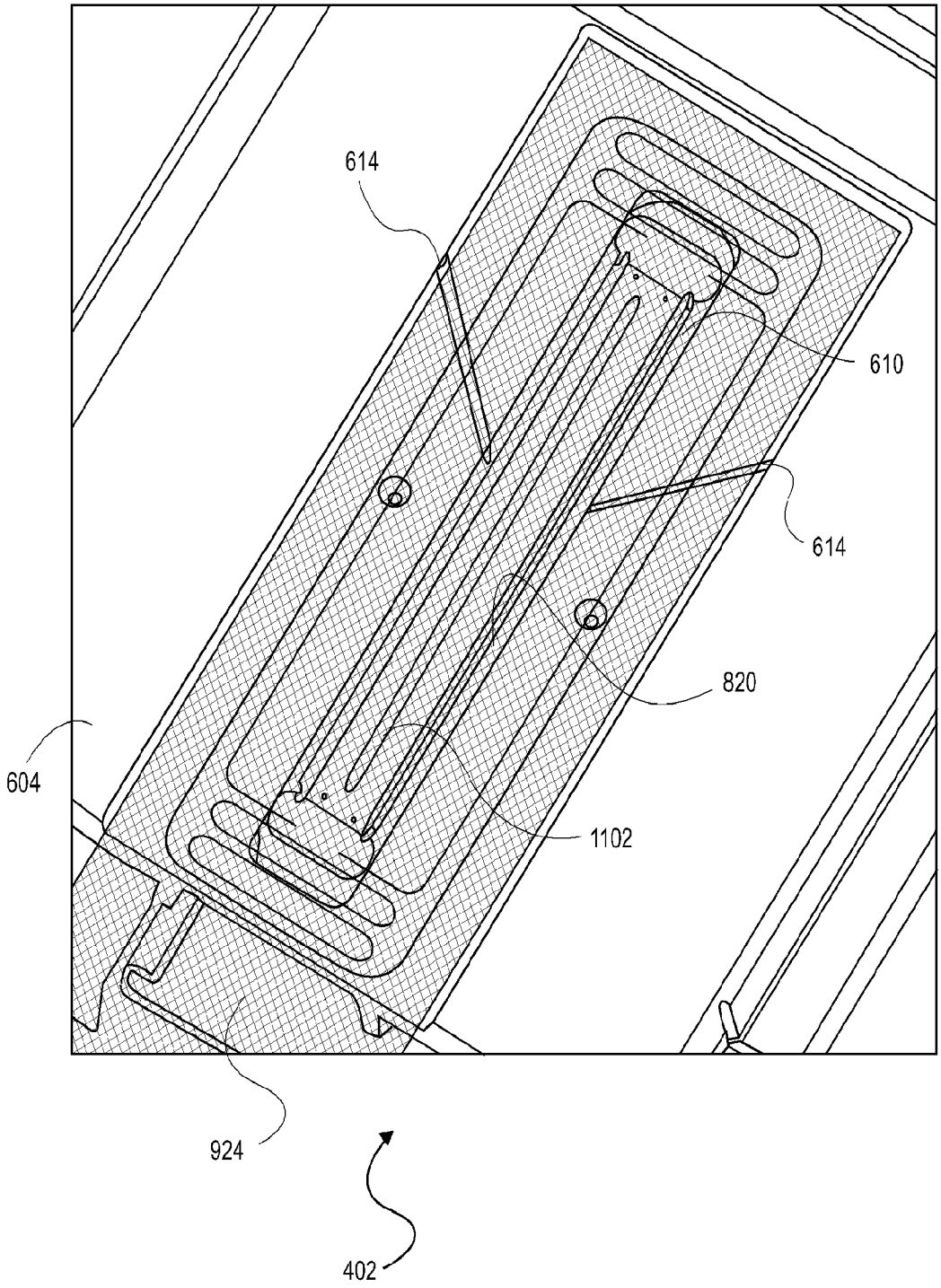
FIG. 11 is a diagram showing vapor can escape through the grooves of the inkjet printhead of FIGS. 6, 7, 8, 9, and 10 even when the printhead die thereof is capped, according to an embodiment of the present disclosure.

FIG. 11 shows how the vapor emanating from the printhead die 820 is still able to escape through the grooves 614 of the inkjet printhead 402, even when the die 820 is capped, according to an embodiment of the present disclosure. The flexible circuit 924 adhesively attached to the surface 606 is depicted translucently in FIG. 11, so that the grooves 614 under the circuit 924 can be seen. The area 1102 denoted in FIG. 11 indicates the area that is capped, and corresponds to the top surface area of the printhead die 820.

Thus, the well 610 and the sides of the printhead die 820 are not covered when the die 820 is capped. This means that any vapor escaping the printhead die 820—either through its sides or through the cap, which may still allow for some vapor to escape from the nozzles on the top of the die 820—is able to escape into the well 610. Once in the well 610, the vapor then escapes through the grooves 614 to the outside environment. As such, it can be said that the grooves 614 externally expose the printhead die 820 even when the die 820 is capped and otherwise not externally exposed but for the grooves 614.

Therefore, the grooves 614 that have been described with reference to FIGS. 6-11 are particularly adapted to increase the vapor loss from the printhead die 820 even when the printhead die 810 is capped or otherwise not externally exposed. For a given type of printhead die 810 and a given type of ink, it can be empirically or otherwise determined (such as by modeling) the minimum amount of vapor loss that may be needed to prevent particle flocculation from occurring within the ink. Thereafter, the number, size, and shape of the grooves 614 can be empirically or otherwise determined (again, such as by modeling) to ensure that at least this minimum amount of vapor loss occurs when the printhead die 810 is capped. For example, in the exemplary embodiments of FIGS. 6-11, there are two grooves 614, each of which is substantially V-shaped. The depth of the grooves 614 can be 380 micron. The width of the grooves 614 can be 300 micron.

Furthermore, the grooves 614 that have been described with reference to FIGS. 6-11 are situated at non-right angles to the sides of the well 610 at which the inner ends of the grooves 614 are adjacent. This can be advantageous so that wiping and/or capping of the printhead die 820 remain unaffected by the presence of the grooves 614. It has been found that where the grooves 614 are at right angles to the sides of the well 610, wiping in particular can be undesirably affected by the grooves 614, in that excess ink is more likely to be wiped into the grooves 614 when they are at right angles to the sides of the 610.

Figure 12:
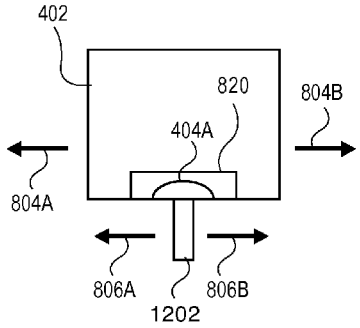
FIG. 12 is a diagram of a rudimentary wiping operation, according to an embodiment of the present disclosure.

FIG. 12 illustratively shows such a wipe operation, according to an embodiment of the present disclosure. Just a single inkjet nozzle 404A of the inkjet printhead 402 is depicted in FIG. 12 for illustrative clarity and convenience, where this nozzle is a part of the printhead die 820. In one embodiment, the inkjet printhead 402 is moved back and forth as indicated by arrows 804A and 804B so that the inkjet nozzle 404A is moved back and forth against a stationary wiper 1202. The wiper 1202 may be a polymer tab, or another type of wiper. In another embodiment, the inkjet printhead 402 remains stationary, and the wiper 1202 is moved back and forth against the inkjet nozzle 404A, as indicated by arrows 806A and 8066.

Figure 13:
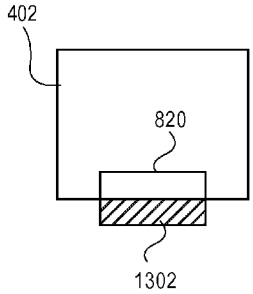
FIG. 13 is a diagram of a rudimentary capping operation, according to an embodiment of the present disclosure.

FIG. 13 illustratively shows a capping operation, according to an embodiment of the present disclosure. A capping material 1302 covers the top of the printhead die 820 of the inkjet printhead 402. The capping material 1302 may be ethylene propylene diene monomer rubber, or another type of capping material. The well 610, the grooves 614, and so on, are not depicted in FIG. 13 for illustrative clarity. In one embodiment, the inkjet printhead 402 may be moved to a parking station within an inkjet-printing device, at which the printhead 402 rests when the printhead die 820 is positioned over the capping material 1302. Additionally or alternatively, the capping material 1302 may be moved so that it makes contact with the printhead 820.

Figure 14:
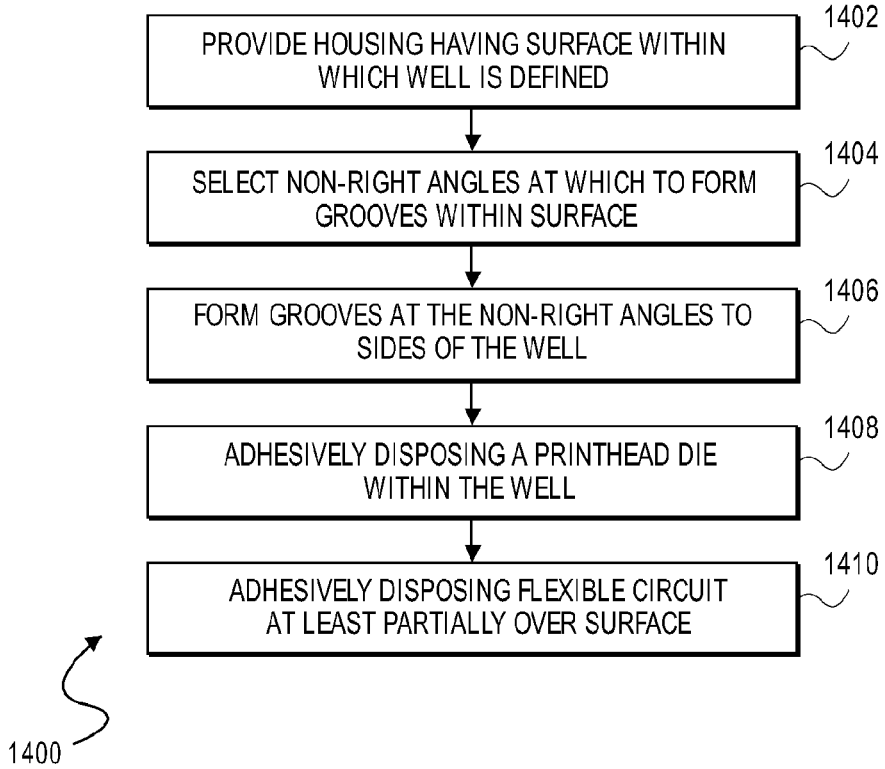
FIG. 14 is a flowchart of a method for fabricating an inkjet-printing device printhead, according to an embodiment of the present disclosure.

FIG. 14 shows a rudimentary method 1400 for at least partially fabricating the inkjet printhead 402, according to an embodiment of the present disclosure. The housing 604 of the inkjet printhead 402 is provided (1402). The housing 604 includes the surface 606 that has been described, which may be part of the plate 608 where the plate is present. The well 610 is defined within the surface 606 in either case.

The non-right angles at which to form the grooves 614 within the surface 606 are selected so that wiping and capping of the printhead die 820 that is to be disposed within the well 610 are not affected by the grooves 614 (1406). Likewise, the number, size, and shape of the grooves 614 may be selected to ensure that a sufficient loss rate of vapor through the nozzles 404 of the printhead die 820 occurs even when the die 820 is capped. The grooves 614 are then formed at the selected non-right angles relative to the sides of the well 610 at which the grooves 614 are located (1406). The grooves 614 may be formed by laser ablation, or in another manner. In one embodiment, the grooves 614 may be formed when the housing 604 itself is formed prior to being provided in part 1402.

The printhead die 820 is then adhesively disposed within the well 610 (1408). As has been described, the adhesive 822 may be employed to adhesively dispose the printhead die 820 within the well 610. Finally, the flexible circuit 924 is adhesively disposed at least partially over the surface 606 (1410).

The flexible circuit 924 has a hole that corresponds to the well 610, so that the printhead die 820 is exposed through the flexible circuit 924.

Figure 15:
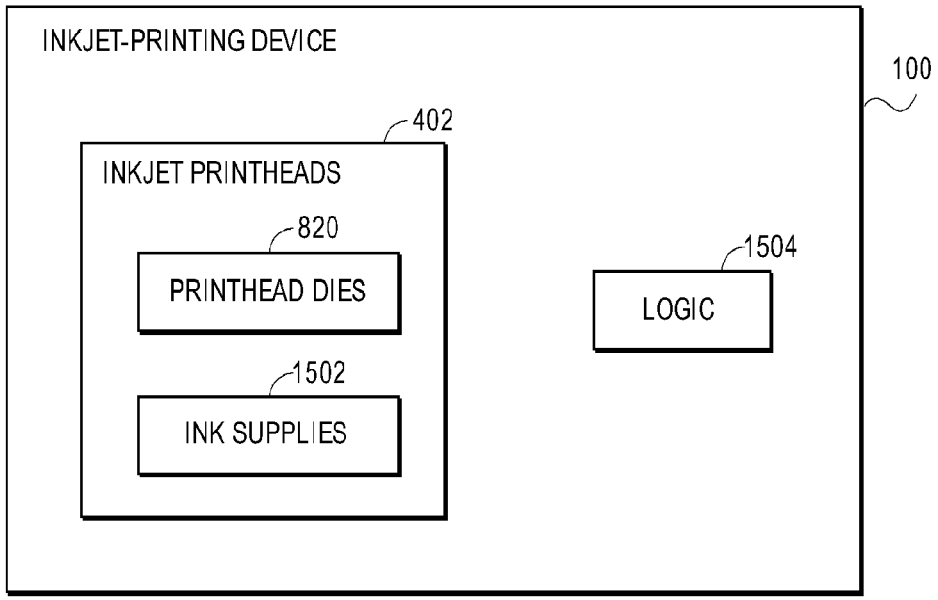
FIG. 15 is a rudimentary block diagram of an inkjet-printing device, according to an embodiment of the present disclosure.

In conclusion, FIG. 15 shows a block diagram of the inkjet-printing device 100, according to an embodiment of the present disclosure. As has been noted, the inkjet-printing device 100 is more generally a fluid-ejection device. The inkjet-printing device 100 is depicted in FIG. 10 as including one or more inkjet printheads 402 and logic 1504. As can be appreciated by those of ordinary skill within the art, the inkjet-printing device 100 may include other components, in addition to and/or in lieu of those depicted in FIG. 15. For example, the inkjet-printing device 100 may include various motors, carriages, and so on, to properly move the inkjet printheads 402 and/or the media on which the printheads 402 form an image.

The inkjet printheads 402 are depicted as part of the inkjet-printing device 100 in FIG. 15 to denote that the inkjet-printing device 100 can include the inkjet printheads 402 that have been described. The inkjet printheads 402 are more generally inkjet-printing mechanisms, are most generally fluid-ejection mechanisms, and can also be referred to as inkjet printhead assemblies. The inkjet printheads 402 include printhead dies 820, as has been described, and in the embodiment of FIG. 15, include integrated ink supplies 1502 contained within the housings 604 of the printheads 402.

The printhead dies 820 include the inkjet nozzles 404 from which ink is actually ejected. The inkjet nozzles 404 may more generally be referred to as fluid-ejection nozzles that eject fluid, such as dye-based ink, pigment-based ink, or another type of ink. As can be appreciated by those of ordinary skill within the art, the inkjet printheads 402 may include other components, in addition to and/or in lieu of those depicted in FIG. 15.

The logic 1504 may be implemented in software, hardware, or a combination of software and hardware, and may be considered the means that performs various functionality. The logic 1504 controls the inkjet printheads 402 to cause the inkjet printheads 402 to eject ink onto media in accordance with an image to be printed onto the media. In this respect, the logic 1504 may, for instance, receive the image to be printed onto the media from a host computing device, such as a desktop or a laptop computer, a digital camera, or another type of device having computing capabilities.

We claim:

1. An inkjet printing device printhead assembly comprising:

a housing;

a surface of the housing;

a well defined within the surface of the housing and adapted to disposal of a printhead die therewithin; and, one or more grooves within the surface of the housing, the grooves having ends, some of the ends adjacent to the well, the grooves externally exposing the printhead die, wherein the grooves are situated at non-right angles to sides of the well at which the some of the ends of the grooves are adjacent.

2. The inkjet printing device printhead assembly of claim 1, wherein the grooves are adapted to increase vapor loss from the printhead die even when the printhead die is capped or otherwise not externally exposed.

3. The inkjet printing device printhead assembly of claim 1, wherein the non-right angles are selected so that wiping and capping of the printhead die are unaffected by the grooves.

4. The inkjet printing device printhead assembly of claim 1, wherein the grooves are first grooves within the surface of the housing, the inkjet printing device printhead assembly further comprising one or more second grooves defined within the surface of the housing, the first grooves extending from the well to the second grooves.

5. The inkjet printing device printhead assembly of claim 4, wherein the housing comprises a plate having one or more sides, such that the surface of the housing is a surface of the plate and such that the well and the first grooves are defined within the plate, and wherein the inkjet printing device printhead assembly further comprises an indentation within a surface of the housing and within which the plate is disposed, the indentation having one or more sides, the second grooves defined between the sides of the plate and the sides of the indentation.

6. The inkjet printing device printhead assembly of claim 5, wherein the plate is adapted to have a flexible circuit being disposed thereover such that the first grooves within the plate are covered by the flexible circuit but such that the ends of the first grooves remain exposed at the sides of the plate and at the sides of the indentation, the flexible circuit electrically connectable to the printhead die disposable within the well.

7. The inkjet printing device printhead assembly of claim 4, wherein the surface of the housing is adapted to have a flexible circuit being disposed at least partially thereover such that the first grooves are covered by the flexible circuit but such that the ends of the first grooves remain exposed at the second grooves and at the well, the flexible circuit electrically connectable to the printhead die disposable within the well.

8. The inkjet printing device printhead assembly of claim 7, further comprising the flexible circuit.

9. The inkjet printing device printhead assembly of claim 1, further comprising a hole extending through a wall of the housing, the hole adapted to supply ink to the printhead die for ejection from the printhead die.

10. The inkjet printing device printhead assembly of claim 1, further comprising the printhead die.

11. The inkjet printing device printhead assembly of claim 1, further comprising a supply of ink contained within the housing.

12. An inkjet printing device comprising:

one or more printhead assemblies, each printhead assembly comprising:

a housing;

a surface of the housing;

a well defined within the surface of the housing and adapted to disposal of a printhead die therewithin; and, one or more grooves within the surface of the housing, the grooves having ends, some of the ends adjacent to the well, the grooves externally exposing the printhead die; and, logic to control the printhead assemblies to cause the printhead assemblies to eject ink onto media in accordance with an image to be printed onto the media, wherein the grooves of each printhead assembly are adapted to increase vapor loss from the printhead die even when the printhead die is capped or otherwise not externally exposed, and wherein the grooves of each printhead assembly are situated at non-right angles to sides of the well at which the some of the ends of the grooves are adjacent, the non-right angles being selected so that wiping and capping of the printhead die are unaffected by the grooves.

13. The inkjet printing device of claim 12, wherein the grooves of each printhead assembly are first grooves within the surface of the housing, the inkjet printing device printhead assembly further comprising one or more second grooves defined within the surface of the housing, the first grooves extending from the well to the second grooves.

14. The inkjet printing device of claim 13, wherein the surface of the housing of each printhead assembly is adapted to having a flexible circuit being disposed at least partially thereover such that the first grooves are covered by the flexible circuit but such that the ends of the first grooves remain exposed at the second grooves and at the well, the flexible circuit electrically connectable to the printhead die disposable within the well.

15. A method comprising:

providing a housing of an inkjet printing device printhead assembly, the housing having a surface within which a well is defined, the well adapted to disposal of a printhead die therewithin; and, forming one or more grooves within the surface of the housing, the grooves having ends, some of the ends adjacent to the well, the grooves externally exposing the printhead die, wherein the grooves of each printhead assembly are adapted to increase vapor loss from the printhead die even when the printhead die is capped or otherwise not externally exposed, and wherein forming the grooves within the surface of the housing comprises:

forming the grooves at non-right angles to sides of the well at which the some of the ends of the grooves are adjacent; and, selecting the non-right angles so that wiping and capping of the printhead die are unaffected by the grooves.

16. The method of claim 15, further comprising adhesively disposing the printhead die within the well.

17. The method of claim 16, wherein the grooves are first grooves within the surface of the housing, the surface of the housing defining one or more second grooves, the first grooves formed so that the first grooves extend from the well to the second grooves, and the method further comprises adhesively disposing a flexible circuit at least partially over the surface of the housing such that the first grooves are covered by the flexible circuit but such that the ends of the first groove remain exposed at the second grooves and at the well, and such that the flexible circuit is electrically connected to the printhead die adhesively disposed within the well.

* * * * *